United States Patent [19]

Scuro

[11] Patent Number: 4,576,082

[45] Date of Patent: Mar. 18, 1986

[54] LINEAR FIBER ARMATURE FOR ELECTROMAGNETIC LAUNCHERS

[75] Inventor: Samuel J. Scuro, Verona, Pa.

[73] Assignee: Westinghouse Electric Corp., Pittsburgh, Pa.

[21] Appl. No.: 453,687

[22] Filed: Dec. 23, 1982

[51] Int. Cl.[3] ..... F41F 1/02

[52] U.S. Cl. ..... 89/8; 124/3

[58] Field of Search ..... 89/8; 124/3; 310/251, 310/238

[56] References Cited

U.S. PATENT DOCUMENTS

| | | | |
|---|---|---|---|
| 3,525,006 | 7/1970 | Parr et al. | 310/251 |
| 3,668,451 | 6/1972 | McNab | 310/251 |
| 3,886,386 | 5/1975 | Hillig | 310/251 |
| 4,267,476 | 3/1981 | Lee | 310/251 |
| 4,306,169 | 12/1981 | Piepers | 310/251 |
| 4,319,168 | 3/1982 | Kemeny | 89/8 |
| 4,358,699 | 11/1982 | Wilsdorf | 310/251 |
| 4,369,692 | 1/1983 | Kemeny | 89/8 |
| 4,430,921 | 2/1984 | Hughes et al. | 89/8 |
| 4,457,205 | 7/1984 | Ross | 89/8 |
| 4,467,696 | 8/1984 | McNab et al. | 89/8 |

OTHER PUBLICATIONS

AFATL-TR-81-99, (11/81), McNab et al., pp. 113-121.

Adkins et al., Proc. 25th Holm Conf. on Electrical Contacts, (1979), pp. 165-170, pp. 171-184.

Reichner (I), Proc. 25th Holm Conf. on Electrical Contacts, (1979), pp. 191-197.

Reichner, Proc. 26th Holm Conf. of Electrical Contacts, (1980), pp. 73-76.

*Primary Examiner*—Sal Cangialosi

*Attorney, Agent, or Firm*—R. P. Lenart

[57] ABSTRACT

An armature for conducting very large DC current between a pair of electrically conductive rails while being driven along the rails under the influence of electromagnetic forces generated by the application of the current includes a plurality of spiraled conductive fibers. These fibers pass through a sleeve and are compacted to a maximum packing density within the sleeve to form a single solidified connection. The brush assembly formed by the sleeve and fibers is mounted on an insulating support structure which is sized to slide between the rails of the electromagnetic launcher.

12 Claims, 3 Drawing Figures

LINEAR FIBER ARMATURE FOR ELECTROMAGNETIC LAUNCHERS

BACKGROUND OF THE INVENTION

This invention relates to armatures for conducting very large currents between parallel rails of electromagnetic launchers and more particularly to such armatures employing multiple conducting fibers to conduct current between the launcher rails.

In the electromagnetic propulsion of projectiles, a very large DC current is injected into the breech end of a pair of parallel conductive rails. A sliding conductive armature serves to conduct current between the rails and is subjected to an electromagnetic force which propels the armature and an associated projectile toward the muzzle end of the rails. Because of the high currents involved in the electromagnetic propulsion of projectiles, sliding conductive armatures must be designed to minimize electrical contact resistance, to have sufficient contact force to maintain a low contact voltage drop in order to prevent rail damage caused by arcing, to have sufficient compliance to accommodate both its own ware and changes in the distance between the launcher rails, and to minimize damage resulting from resistive heating. A fiber armature has been disclosed in a copending commonly assigned application entitled "Multiple Fiber Armatures for Electromagnetic Launchers", Ser. No. 328,887 filed Dec. 9, 1981 by Ross, now U.S. Pat. No. 4,457,205, which provides additional background information and is hereby incorporated by reference.

SUMMARY OF THE INVENTION

An armature for conducting very large DC current between a pair of electrically conductive rails, while being driven along the rails under the influence of electromagnetic forces generated by the application of the very large DC current, constructed in accordance with this invention comprises: an insulating support structure; a plurality of conductive fibers, each having a length greater than the distance between the conductive rails; a sleeve having an opening through which the conductive fibers pass, wherein the conductive fibers are compacted to maximum packing density within the sleeve; and means for mounting the sleeve on the support structure. The plurality of cantilevered conductive fibers of this structure are angled and spiralled for low contact load. Maximum packing density of the fibers within the sleeve produces a uniform current distribution which eliminates excessive current density concentrations and prevents gross armature melting.

This invention also encompasses a fiber brush assembly which is suitable for making sliding contact with a slip ring conductor. A high current brush constructed in accordance with this invention comprises: a plurality of conductive fibers; a sleeve having an opening through which said conductive fibers pass; and wherein said conductive fibers are compacted to a maximum density within said sleeve.

DESCRIPTION OF THE PREFERRED EMBODIMENT

Figure 1:
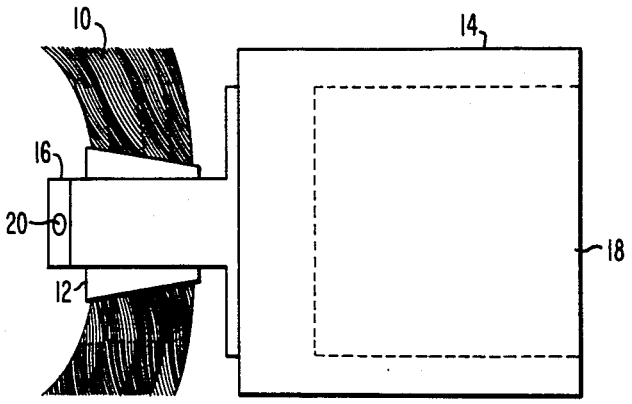
FIG. 1 is a top view of an armature assembly constructed in accordance with one embodiment of this invention.

Referring to the drawings, FIG. 1 is a top view of an armature assembly constructed in accordance with one embodiment of this invention. A brush assembly comprising a plurality of conductive fibers 10 which pass through an opening in sleeve 12, is attached to an insulating support structure 14 by a brush holder mounting means 16. Insulating support structure 14 is sized to slide between a pair of parallel launching rails in an electromagnetic launcher and serves to position the brush assembly between the rails. In this embodiment, an opening 18 is shown within insulating support structure 14 for receiving a projectile. However, it will be apparent to those skilled in the art that insulating support structure 14 may itself be the projectile, may lie adjacent to a projectile, or may be associated with a projectile in some other manner. The sleeve 12 of the brush assembly passes through an opening in mounting means 16 and is held in place by a set screw 20.

Figure 2:
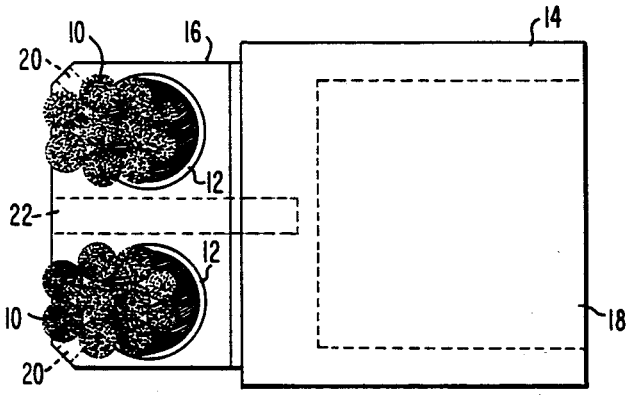
FIG. 2 is a side view of the armature assembly of FIG. 1.

FIG. 2 is a side view of the armature assembly of FIG. 1. This embodiment uses two fiber brush assemblies each of which contains ten bundles of 0.006" copper fibers such as those used to form flexible commercial welding type cable. Each bundle contains 1,100 wire fibers. These bundles were inserted into openings of cylindrical annealed copper sleeves 12. The copper sleeves were then rotary swaged until conductive fibers 10 reached a maximum packing density within each sleeve and thereby formed a single solidified connection. The sleeves 12 were inserted into an aluminum mounting block 16 and secured by way of set screws 20. A bolt 22 serves as means for attaching mounting block 16 to insulating support structure 14.

Figure 3:
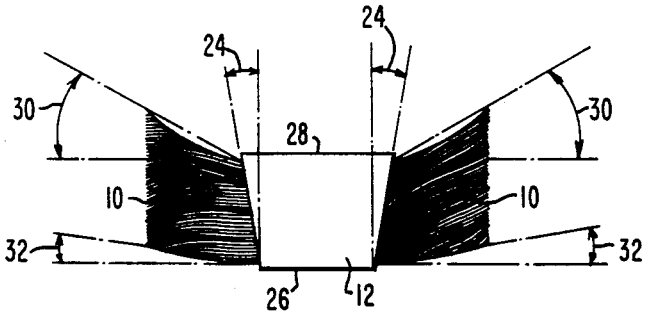
FIG. 3 is a top view of an armature brush assembly for use in the armature assembly of FIG. 1.

FIG. 3 is a top view of the brush assembly of the armature assembly of FIG. 1. Each end of sleeve 12 is beveled at an angle 24 of 10° to form a narrow side 26 and a wide side 28. When the brush assembly is mounted onto the armature assembly, the narrow side 26 of sleeve 12 is mounted closest to the insulating support structure 14. Multiple conductive fibers 10 pass through an opening in sleeve 12 and are spiralled with respect to the axis of sleeve 12. The conductive fibers 10 have been bent as a whole to an angle 30 of 40° at the trailing edge and an angle 32 of 10° at the forward edge. In addition, the ends of conductive fibers 10 are cut along two planes which lie perpendicular to the axis of sleeve 12. To improve electrical contact between conductive fibers 10 and the projectile launching rails of the launcher, the ends of conductive fiber 10 are polished to a flat surface.

Armature assemblies in accordance with this invention have been constructed and tested in an electromagnetic launcher. One of these armature assemblies having a brush assembly comprising 7,700 copper fibers, each having a diameter of 0.006", was used to accelerate a 317 gram projectile to a speed of 4.2 kilometers per second with a pulsed current of 2.1 million amperes. Despite being subjected to a peak acceleration of 236,000 g's., the projectile and armature assembly left the barrel intact and went through the center of a ¼" thick steel witness plate before being destructively caught in a catch tank. Rail damage was minimal, with two smooth dimeshaped holes about 2 millimeters deep having been produced approximately 15 centimeters from the breech of the launcher. The remainder of the rails and insulation showed no damage through all interior surfaces were coated with a thin layer of soot.

Localized armature melting was eliminated through the use of a plurality of electrical contacts, each having sufficient compliance in a directional normal to the projectile launching rails to minimize resistive heating. Thermal transfer through the solidified center segment of the conductive fibers and through the aluminum brush holder improved heat dissipation. Low contact resistance at extreme current densities was achieved through the use of spiralled conductive fibers which provided an adequate normal force on each of the fibers. This spiral design compensates for variations in rail spacing and permits adequate mechanical compliance for the polished conductive fiber tips to remain in contact with the rail surface. It also provides for continued contact with the conductive rails when the fibers erode as they travel through the barrel. The brush assembly of this invention can be assembled without the need for soldering or metal joining procedures. The spiralled fibers provide self support and limit deflection while in the presence of high electromagnetic fields. Spiralling allows compliance to variations along the contact rails as the armature travels to maintain good electrical contact, thereby reducing the destructive effects of arcing. Through the use of flexible conductive fibers, low contact forces are maintained to make good electrical contact, thereby resulting in low friction losses.

Although this invention has been described in terms of what is believed to be the preferred embodiment, it will be apparent to those skilled in the art that various changes and modifications may be made without departing from the invention. For example, although the brush assembly of the armature assembly of this invention has been an efficient linear sliding contact during a pulsed application, it can also be used as a continuous operaing brush on a slip ring surface. Because the conductive fibers have been solidified within the sleeve of the brush assembly, soldering or joining heavy electrical conductors to the brush is possible and can readily be made when required.

What is claimed is:

1. An armature for conducting DC current between a pair of electrically conductive rails while being driven along the rails under the influence of electromagnetic forces generated by the application of said DC current, said armature comprising:

an insulating support structure;

a plurality of conductive copper fibers;

a cylindrical sleeve having an opening through which said conductive fibers pass, wherein said conductive fibers are compacted to form a solid mass within said sleeve; and means for mounting said sleeve on said support structure;

wherein said conductive fibers are spirally disposed with respect to the axis of said sleeve.

2. An armature as recited in claim 1, wherein:

each end of said sleeve is beveled at a 10° angle such that said sleeve has a narrow side and a wide side with the narrow side being closer to said support structure.

3. An armature as recited in claim 2, wherein:

said conductive fibers are bent at an angle between 10° and 40° with respect to the axis of said sleeve, with said conductive fibers which are closest to said support structure being bent at a 10° angle and said conductive fibers which are farthest from said support structure being bent at a 40° angle.

4. An armature as recited in claim 1, wherein said armature is capable of carrying currents in excess of 2 million amperes while being accelerated to speed in excess of 4 kilometers per second.

5. An armature as recited in claim 1, wherein said means for mounting said sleeve on said support structure comprises:

a mounting block having an aperture for receiving said sleeve.

6. An armature as recited in claim 5, wherein said mounting block is constructed of aluminum.

7. An armature as recited in claim 1, wherein one end of each of said conductive fibers is cut along a first plane perpendicular to the axis of said sleeve and the other end of each of said conductive fibers is cut along a second plane perpendicular to the axis of said sleeve.

8. An armature as recited in claim 1, wherein said plurality of conductive fibers comprises approximately 7,700 conductive fibers.

9. An armature as recited in claim 1, wherein said conductive fibers are polished on each end in a plane perpendicular to the axis of said sleeve.

10. A brush for conducting electric current comprising:

a plurality of conductive copper fibers, a cylindrical sleeve having an opening through which said conductive fibers pass; and wherein said conductive fibers are compacted to form a solid mass within said sleeve;

wherein said conductive fibers are spirally disposed with respect to the axis of said sleeve.

11. A brush as recited in claim 10, wherein said brush is capable of carrying currents in excess of 2 million amperes while being accelerated to a speed in excess of 4 kilometers per second.

12. A brush as recited in claim 10, wherein one end of each of said conductive fibers is cut along a plane perpendicular to the axis of said sleeve.

* * * * *